US007465683B2

(12) United States Patent
McMurray

(10) Patent No.: US 7,465,683 B2
(45) Date of Patent: Dec. 16, 2008

(54) FUNCTIONAL DOUBLE-FACED PERFORMANCE WARP KNIT FABRIC, METHOD OF MANUFACTURING, AND PRODUCTS MADE THERE FROM

(76) Inventor: Brian L. McMurray, 1600 Morganton Rd. - Y72, Pinehurst, NC (US) 28374

( * ) Notice: Subject to any disclaimer, the term of this patent is extended or adjusted under 35 U.S.C. 154(b) by 61 days.

(21) Appl. No.: 10/720,947

(22) Filed: Nov. 24, 2003

(65) Prior Publication Data

US 2005/0112975 A1 May 26, 2005

(51) Int. Cl.
*D04B 21/18* (2006.01)
*D04B 21/16* (2006.01)
*D04B 21/14* (2006.01)

(52) U.S. Cl. ..... 442/314; 442/67; 442/71; 442/152; 442/164; 442/306; 442/312; 442/313

(58) Field of Classification Search ..... 442/67, 442/71, 152, 164, 306, 312, 313, 314
See application file for complete search history.

(56) References Cited

U.S. PATENT DOCUMENTS 1,801,825 A 4/1931 Plush
2,696,723 A 12/1954 Frith
2,957,327 A 10/1960 Glover
3,041,861 A * 7/1962 Kasey ..... 66/195
3,043,124 A 7/1962 Hubbard
3,254,510 A * 6/1966 Lesley ..... 66/195
3,710,598 A 1/1973 Wilkins
3,971,234 A 7/1976 Taylor
4,567,075 A 1/1986 Krawczyk
4,574,397 A * 3/1986 Dennard ..... 2/69.5
4,712,281 A 12/1987 Scheller
4,811,573 A 3/1989 Sternlieb
4,870,839 A * 10/1989 Odham ..... 66/125 A
4,879,169 A * 11/1989 Zafiroglu ..... 442/183
4,881,383 A 11/1989 Spillane
5,029,457 A 7/1991 Gaijar
5,052,084 A * 10/1991 Braun ..... 24/163 R
5,065,600 A * 11/1991 Byles ..... 66/193
5,123,117 A * 6/1992 Prendergast ..... 2/108
5,222,313 A * 6/1993 Dowdy et al. ..... 36/138
5,528,910 A 6/1996 Azais
5,542,269 A * 8/1996 Richards ..... 66/195
5,619,869 A * 4/1997 Tacy ..... 66/195
5,657,648 A 8/1997 Ives
5,727,401 A 3/1998 Statham
5,735,835 A * 4/1998 Holland ..... 604/331
5,855,124 A * 1/1999 Donaghy et al. ..... 66/195
5,855,125 A 1/1999 Lohmueller
5,916,273 A 6/1999 Hepfinger (Continued)

OTHER PUBLICATIONS

Definition of the word "fabric" Complete Textile Glossary, Celanese Acetate, 2001 (no month).*

*Primary Examiner*—Andrew T Piziali
(74) *Attorney, Agent, or Firm*—MacCord Mason PLLC

(57) ABSTRACT

An integrally formed stretch warp knit fabric structure formed using at least three guide bars, a fully or partly threaded first front guide bar, a second fully or partly threaded middle guide bar and third fully or partly threaded back guide bar that are knitted to form one single layer fabric having a definitive two-sided qualities; and a method of making the fabric; and articles using said fabric.

36 Claims, 3 Drawing Sheets

U.S. PATENT DOCUMENTS

| | | | |
|---|---|---|---|
| 6,131,419 | A | 10/2000 | Rock |
| 6,196,032 | B1 | 3/2001 | Rock |
| 6,199,410 | B1 | 3/2001 | Rock |
| 6,427,493 | B1 | 8/2002 | Kasdan |
| 6,446,472 | B2 | 9/2002 | West |
| 6,634,190 | B2 | 10/2003 | Didier-Laurent |

* cited by examiner

FUNCTIONAL DOUBLE-FACED PERFORMANCE WARP KNIT FABRIC, METHOD OF MANUFACTURING, AND PRODUCTS MADE THERE FROM

BACKGROUND OF THE INVENTION (1) Field of the Invention

The present invention relates generally to textile fabrics and, more particularly, to a double-faced warp knit fabric for performance applications.

(2) Description of the Prior Art

Prior art double-faced warp knit fabrics are commonly found to be pile fabrics, i.e., to realize a difference on the face and back sides, a warp-knitted pile fabric manufacturing machine employs an auxiliary mechanical device, such as a plush needle bar. However, this pile fabric is limited in terms of the quality that differs from face to back: it is only capable of producing a plush face side and a back side, i.e., only a single quality difference is possible to realize from this fabric-forming method. Examples of pile fabric found within the relevant art include the following:

U.S. Pat. No. 3,710,598 issued Jul. 16, 1973 to Wilkins for a Pile fabric method.

U.S. Pat. No. 3,043,124 issued Jul. 10, 1962 to Hubbard for a Knitted pile fabric.

U.S. Pat. No. 2,957,327 issued Oct. 26, 1960 to Glover for a Warp knitted pile fabric.

U.S. Pat. No. 2,696,723 issued Dec. 14, 1954 to Frith for a Locked pile fabric.

U.S. Pat. No. 1,801,825 issued Apr. 21, 1931 for a Plush warp knit fabric.

Other examples of double-faced warp knit fabrics commonly employ multilayer fabrics, i.e., are not single layer fabrics, and, in particular relate to velvet fabrics or velour fabrics having at least two layers, and spacer fabrics, which "sandwich" an additional layer of spacer yarns between the two sides or faces of the fabric. In these cases, while the fabrics may be constructed to include different qualities on the face and back, the fabrics have a thickness dimension that limits the applications of the fabric, and/or limits the characteristics of the fabric, e.g., by increasing the weight of the fabric, and often the stiffness due the increase in fabric thickness. From the standpoint of the present invention, these properties associated with multilayer fabrics are not desirable.

Examples of multilayer double-faced warp knit fabrics include the following:

U.S. Pat. No. 6,634,190 issued Oct. 21, 2003 to Didier-Laurent for a Double-faced thick knitted fabric with flexible structure. A thick double-face knitted fabric has a front face (1) and a rear face (2), which are connected to one another by an intermediate layer (3), and is produced on a circular knitting machine. The intermediate layer (3) is produced solely from binding monofilaments. The knitted fabric which is produced has the qualities of flexibility and of elasticity, and a minimum thickness of 3 mm. A knitting method and a machine for producing the knitted fabric are also disclosed.

U.S. Pat. No. 6,199,410 issued Mar. 13, 2001 to Rock, et al. for a Double face warp knit fabric with two-side effect. A fabric with a patterned velvet on one face and a different patterned velour on the other is formed from a three dimensional fabric using a double bar knitting machine. Preferably, at least either the stitching or backing yarn within the fabrics is made with a bulk high enough so that after the three dimensional structure is knitted and split, the back can be napped to form the velour from such yarn.

U.S. Pat. No. 6,196,032 issued Mar. 6, 2001 to Rock, et al. for a Double face warp knit fabric with two-side effect. A fabric with a patterned velvet on one face and a different patterned velour on the other is formed from a three dimensional fabric using a double bar knitting machine. Preferably, at least either the stitching or backing yarn within the fabrics is made with a bulk high enough so that after the three dimensional structure is knitted and split, the back can be napped to form the velour from such yarn.

U.S. Pat. No. 6,131,419 issued Oct. 17, 2000 to Rock, et al. for a Two face cut loop fabric. A cut loop fabric, knit on a conventional terry knitting machine utilizing a reverse plaiting technique, is provided. The fabric has a technical face with a raised or napped surface, and a technical back in which the sinker loops are sheared in order to form a cut loop velvet surface.

U.S. Pat. No. 6,446,472 issued Sep. 10, 2002 to West, et al. for a Fabric structure with stand-off design. A fabric including raised members that effectively separate the wearer from the fabric base. The raised members add a third dimension of depth or thickness to a traditionally two-dimensional piece of apparel allowing the fabric base to remain separate from the wearer's body which provides greater comfort and breathability to the wearer. The raised members may be placed in useful proportion with open holes or closed spaces of the fabric enhancing the quality and functionality of the apparel.

U.S. Pat. No. 6,427,493 issued Aug. 6, 2002 to Kasdan, et al. for a Synthetic knit fabric having superior wicking and moisture management properties A weft knit synthetic fabric having an irregular pique construction prepared on a double knit machine having four feeds, two of which are microfiber yarn and two of which are regular non-microfiber yarn. The fabric is formed with at least 40 weight percent microfiber yarn and the balance conventional non-microfiber yarn which is worn against an individual's body for maximum moisture absorption with the microfilament knit on the face to provide maximum siphon to remove the moisture from a wearer's body. The knit fabric is stated to be particularly well suited for athletic wear.

U.S. Pat. No. 5,916,273 issued Jun. 29, 1999 to Hepfinger for a Warp knitted plush fabric. A warp-knitted fabric of at least three-bar construction, which is comprised of multifilament synthetic pile yarns on the technical back which are raised or broken to produce a plush surface and monofilament synthetic ground yarns on the technical face, the pile yarns being comprised of microdenier filaments having a denier no greater than 1.1.

U.S. Pat. No. 5,855,125 issued Jan. 5, 1999 to Lohmueller, et al. for a Method for constructing a double face fabric and fabric produced thereby. A method of constructing a double face fabric is provided. The first step in the method is to knit a three dimensional knit fabric which has a first fabric layer, a second fabric layer and a plurality of yarns that interconnect the two layers. The three dimensional knit fabric is prepared using a conventional double needle bar warp knitting machine. Then, the yarn connecting the two layers is cut, resulting in two pieces of fabric having a velvet surface on one side, and a flat knit surface on the other. The flat knit surface is then raised by a process such as napping to pull portions of the pile yarns through the fabric layer to the technical back, in order to form a pair of double face fabrics, each with a first velvet surface and a second fleece surface. Preferably, the fabric is knit so that after napping it can be stretched. In this manner a wide variety of fabrics can be created.

U.S. Pat. No. 5,727,401 issued Mar. 17, 1998 to Stafham for a Fire resistant fleece fabric and garment. A fire resistant fabric (10) suitable for use as an inner thermal barrier layer in a layered firefighters' turnout garment (30). The fabric is a 3-end knit fleece having stitch yarns (12), tie yarns (14), and nap yarns (18), all made of fire resistant fibers. The nap yarns are pulled away from the stitch and tie yarns to form a fleece.

U.S. Pat. No. 5,657,648 issued Aug. 19, 1997 to Ives, et al. for a Elastic fabric and method of making same. An elastic web fabric and method for producing the same. The resulting fabric is curl-free and has bi-directional stretch of between about 50-125% stretch in the width direction and 50-200% stretch in the length direction. In the preferred embodiment, the fabric includes a center marker formed from a two-needle shift of two rubber yarns to provide a centering line to aid in assembly of a finished article. Also, in the preferred embodiment, the left top edge of the fabric has about six rubber yarns and the right top edge has about 5 rubber yarns to prevent curling to produce a fabric which is more easily cut and fabricated into the finished article.

U.S. Pat. No. 5,528,910 issued Jun. 25, 1996 to Azais for a Double-faced weft knitted fabric, notably for leisure clothes. The double-faced knitted fabric, notably for leisure clothes, according to the invention, has one face with a surface in a first material, preferably cotton, whether pure or in a mixture, and the other face with a surface in a second material, preferably wool, whether pure or in a mixture. The knitted fabric is obtained on at least three feeds, two feeds with a full cardigan type knitting with a yarn of the first material and a second yarn of the second material and one feed with a jersey type knitting using a third yarn having the first material at least on the surface. In particular, this third yarn can be an elastic yarn, comprising for example, a covered elastomer yarn whose cover is in the first material.

U.S. Pat. No. 5,029,457 issued Jul. 9, 1991 to Gajjar for a Method of warp knitting. Wrap knit fabric having a two and three-course repeat pattern of alternating first and second, or first, second and third and first, second, third and fourth bar yarns. The fabric is prepared by interlocking the first and second or first, second and third bar yarns using a combination of knit and laid-in stitches in the same for two course, and same and opposite fashion for three and four course repeat.

U.S. Pat. No. 4,881,383 issued Nov. 21, 1989 to Spillane, et al. for a Warp knitted fabric with satin-like back and brushable face and method of knitting same. A three-bar warp knitted fabric having a brushable pile surface at its technical face and a satin-like surface at its technical back is produced on a three-bar warp knitting machine by knitting overfed pile yarns on the machine's bottom bar to produce brushable pile loops at the fabric's technical face, knitting satin-effect yarns on the machine's middle bar in extended underlaps to produce a satin-like technical back of the fabric and knitting relative smaller denier tie-down yarns on the machine's top bar in a chain stitch pattern to also extend at the fabric's technical back in crossing relationship to the satin-effect yarn underlaps to shield them from picking without significantly obstructing their satin-like appearance.

U.S. Pat. No. 4,811,573 issued Mar. 14, 1989 to Sternlieb for a Two face stitch bonded fabric. A decorative fabric has two faces and is made on two stitch through type machines of different gauge. The fabric has a non-woven, flexible substrate and a first plurality of spaced yarns laid on the front face of the substrate in the filling direction. First knitting threads of predetermined gauge form a series of warpwise loop chains which bind the first filling yarns and the substrate into an integral structure. The rear face of the substrate has a second plurality fo spaced yarns laid thereon in the filling direction, and second knitting threads of predetermined gauge which are different from the predetermined gauge of said first knitting threads, thereby forming a series of warpwise loop chains which bind the second plurality of spaced yarns and said substrate into an integral structure.

U.S. Pat. No. 4,712,281 issued December 1987 to Scheller for a Napped warp-knitted fabric and method of producing same. Warp knitted fabric of an at least two bar construction nappable on both fabric faces is produced on a warped knitted machine of at least three bar construction by utilizing a pile loop forming device on the bottom bar while simultaneously knitting a ground yarn substrate on the middle bar and knitting pile yarns on the top bar to be knitted into the substrate in needle loops at the technical fabric face and extended pile underlap loops at the technical fabric back. At least one surface of the fabric is napped, the extended underlap loops at the technical back being nappable to a plush surface effect while also being adapted to be partially drawn through the substrate to the technical face upon napping of the needle loops to produce a comparable plush surface at the technical face.

U.S. Pat. No. 4,567,075 issued Jan. 28, 1986 to Krawczyk for a Double faced knit fabric and method. A nappable, dimensionally stable fabric is produced on a three bar warp knitting machine by over feeding the yarns fed by the bottom bar to provide nappable loops, and by knitting the yarns fed by the top bar in a pattern providing nappable floats, longitudinal stability being provided by yarns knit from the middle bar, and lateral stability being provided by the partially napped floats.

U.S. Pat. No. 3,971,234 issued Jul. 27, 1976 to Rock, et al. for a Double-knit elastic fabric with raised patterns. An elastic double-knit fabric having alternating front and back wales knit from an elastic and inelastic yarn knit together in spaced patterns of adjacent stitches in adjacent front wales and in selected stitches in at least every fourth course in the back wales, all the remaining stitches in the fabric containing only inelastic yarn. This invention relates to weft-knitted fabrics and more particularly to double-knit fabrics in which elastic yarn is present in a stretched condition in the face and back stitches of preselected areas of the fabric. The elastic properties of spandex yarns enable manufacturers to produce a wide variety of fabrics ranging from foundation fabrics with outstanding holding power and figure control to outerwear, sportswear and underwear fabrics with excellent dimensional recovery providing ideal fit and comfort at all levels of body extension. In making elastic, double-knit fabrics, it is customary for the elastic yarn to be knitted in the back stitches of the fabric to reduce "grin through" and to make economical use of the elastic yarn. In the present invention, in addition to the back stitches, the elastic yarn is also selectively incorporated into face stitches, or front wales of a double-knit fabric producing fabric relief patterns without departing from the basic double-knit construction. According to this patent, this enables one to produce double-knit fabrics in which selected face stitches assume a more compact appearance or to produce fabrics with large areas of compact stitches in which the contraction of this area distorts the normal wale/course configuration to give curved courses maintaining relatively flat fabrics. In addition, double-knit fabrics can be produced in which certain areas are raised from the general fabric plane through the contracting action of the other areas.

Thus, there remains a need for a single layer double-faced warp knit fabric having different qualities on the face and back sides, and wherein the fabric is not a pile fabric.

SUMMARY OF THE INVENTION

The present invention provides embodiments of single layer double-faced warp knit fabrics having different qualities on the face and back sides that are aesthetically enhanced fabrics with advantageous performance properties. The present invention also provides methods for producing such fabrics.

In an aspect the present invention comprises an integrally formed stretch warp knit fabric structure formed using at least three guide bars, a fully or partly threaded first front guide bar, a second fully or partly threaded middle guide bar and third fully or partly threaded back guide bar that are knitted to form one single layer fabric having a definitive two-sided, and even more desirably, two distinctive and different colors on each side as a result.

More specifically an embodiment of the present invention provides a definitive two-sided single layer warp knit fabric structure with a first technical face side comprised of a fully dyeable synthetic either continuous multifilament or a spun staple length yarn such as nylon or polyester, preferably nylon, and a second technical back side comprised of a textured micro-denier multifilament synthetic yarn such as nylon or polyester, preferably polyester, and a base structure comprised of spandex elastomeric yarn.

Any of the conventional yarn types known in the art may be utilized to produce a warp knit fabric of the present invention, including, but not limited to natural and synthetic yarns produced from spandex, nylon, polyester, viscose, cotton and/or blends thereof. In a preferred embodiment of the present invention the technical back-side of the single layer warp knit fabric is comprised of a substantially resilient and thermosettable continuous filament synthetic yarn. The synthetic yarn may comprise a textured multifilament yarn, a flat non-textured multifilament yarn, or a spun staple yarn wherein the synthetic yarn comprises polyester or nylon. In the case of a flat non-textured multifilament yarn, a higher reflectance surface can be produced thereby imparting a metallic look effect, particularly when the yarn is either solution dyed, yarn dyed, or fabric piece dyed in the into silver or gold metallic looking colors. A similar look may be accomplished when using a preferred textured multi-filament micro-denier polyester yarn which optimizes moisture wicking action when against and in direct contact with the skin of the garment wearer, A particularly desirable combination is achieved when any fashionable color such as Navy or Red, for example, is dyed only on the yarn visible in the technical face side of the fabric while a contrasting and different color such as silver is dyed on the yarn visible on the technical back side of the fabric, resulting in a silver backed fabric having any color on the reverse face of the product.

In all of the described embodiments of the present invention it is emphasized that the synthetic continuous filament yarn spandex and the synthetic continuous multi-filament or spun staple yarn components of nylon, and polyester used in the first and second discrete technical face and technical back fabric sides are chosen and required in the present invention for their unique hydrophilic or hydrophobic moisture transfer properties as employed in the fabric while still maintaining all functions of fabric stretch, thickness, and comfort breath ability.

A feature of the present invention is that an embodiment of the present invention provides an economic double faced or distinctly two-sided warp knit fabric that has first and second knit parallel yarn layers integrally knitted and joined together by a series of knit courses forming a resultant single thickness fabric which discretely secures the first and second distinct and different yarn layers together in a tightly spaced relationship parallel to each other.

Another feature of the present invention is that an embodiment of the present invention provides a warp knitted single-layer performance fabric that has an optimized moisture wick ability function achieved through effectively combining the distinct hydrophilic properties of an outer technical face yarn area that is intimately connected by construction at a regular and uniform frequency in the knitting sequence to an inner technical back micro-denier hydrophobic yarn area possessing high moisture wicking properties. The yarn selected for the outer technical face surface area is to provide a greater hydrophilic property than the yarn selected for the inner technical back surface area, thereby utilizing a mechanism referred to as a push-pull function for moving the perspiration off the surface of the skin of the garment wearer and efficiently being pulled to the outer surface away from the body and available for evaporation from the outer fabric surface area. This outer surface yarn will also be the visible ingredient in the fabric therefore will be dyed into fashion colors as desired for the appropriate end use such as active sportswear, swimwear, performance wear, athletic wear, intimate apparel, medical, and fitness wear garment applications. The fabric inner surface technical back, which contacts the skin of the wearer, will thus be hidden from view.

A further feature of the present invention is that an embodiment of the present invention provides a high performance moisture management fabric that is yet further enhanced through chemical means during the dyeing and finishing process by the additional application of finishes such as wickable finish, anti-microbial finish, anti-static finish, softeners, or water repellency finishes applied on the fabric during wet processing, maximizing desirable hydrophobic/hydrophilic fabric properties.

Yet another feature of the present invention is that an embodiment of the present invention provides a multi-directional stretch performance fabric utilizing synthetic polymer spandex elastomeric yarn such as LYCRA yarn produced by the DuPont Company of Wilmington, Del. The inclusion of spandex yarn into the fabric structure is integral to the successful execution of separation of the two distinct yarn systems into technical face and technical back.

A further feature of the present invention is that an embodiment of the present invention provides for a sueded or brushed technical back fabric surface for maximizing wearer comfort and increasing the thermal retention properties of the fabric and garment.

Embodiments of the fabric of the present invention may be advantageously utilized in articles of manufacture. Accordingly, further aspects of the present invention are articles of manufacture comprising a fabric of the present invention, such as a T-shirt, sleeveless tank top, etc.

Embodiments of the present invention provide methods of making engineered high performance warp knitted double faced fabrics that may have a full dull luster face, a bright or high luster face, a Printed face, Embossed face, or Specialty Yarn faced fabric consisting of a first distinct and opaque outer technical face fabric surface, a second distinct inner technical back fabric surface that may be either fully dull or highly bright in luster, and that will facilitate the manufacturing of finished fashion swimwear, performance competition swimwear, active performance or fitness wear, athletic wear, intimate apparel, and medical garments in a minimal number of manufacturing steps.

These and other aspects of the present invention will become apparent to those skilled in the art after a reading of the following description of the preferred embodiment when considered with the drawings.

DETAILED DESCRIPTION OF THE PREFERRED EMBODIMENTS

Figure 1:
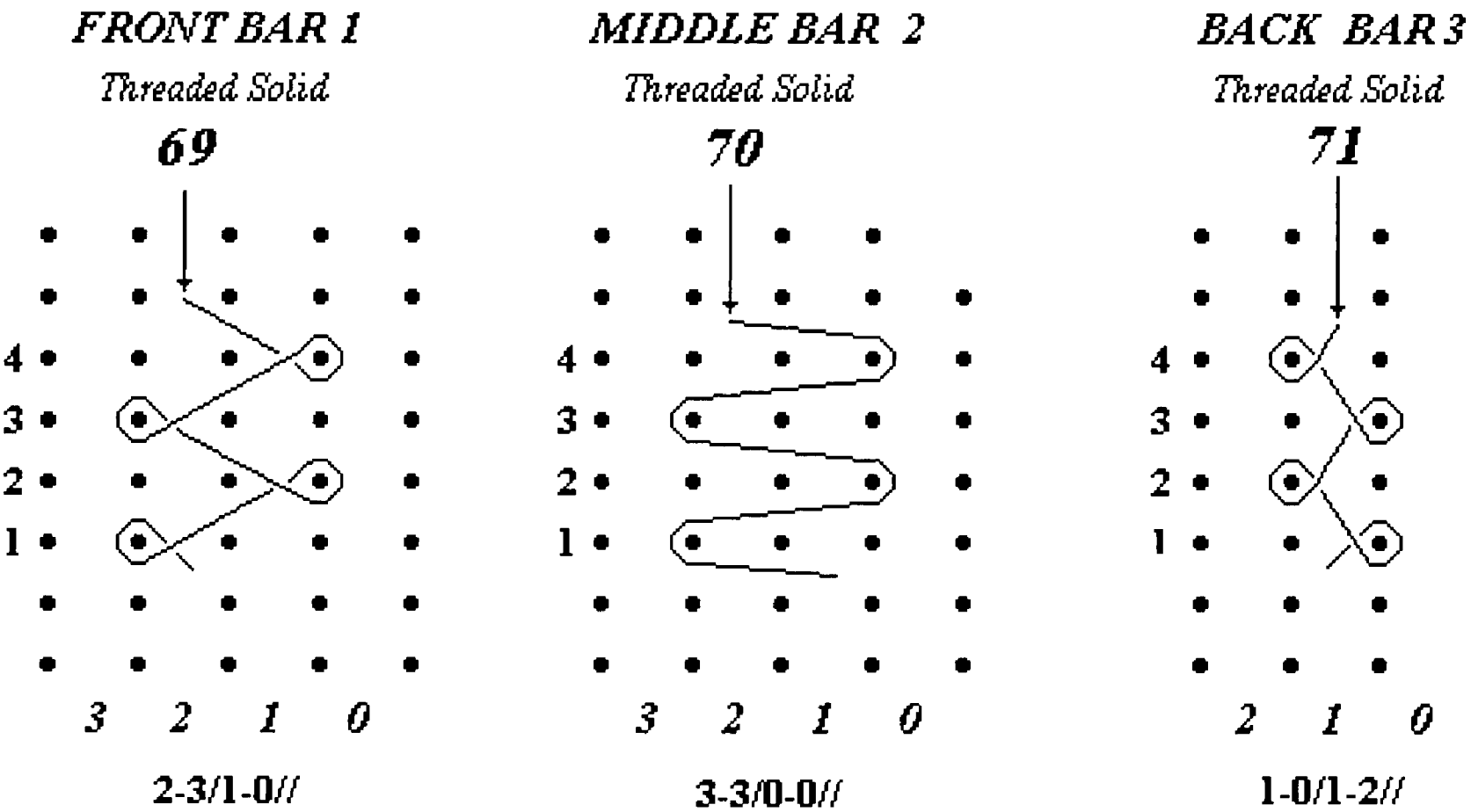
FIG. 1 is a pattern for making a knitted fabric constructed according to the present invention.

In the following description, like reference characters designate like or corresponding parts throughout the several views. Also in the following description, it is to be understood that such terms as "forward," "rearward," "front," "back," "right," "left," "upwardly," "downwardly," and the like are words of convenience and are not to be construed as limiting terms.

Figure 2:
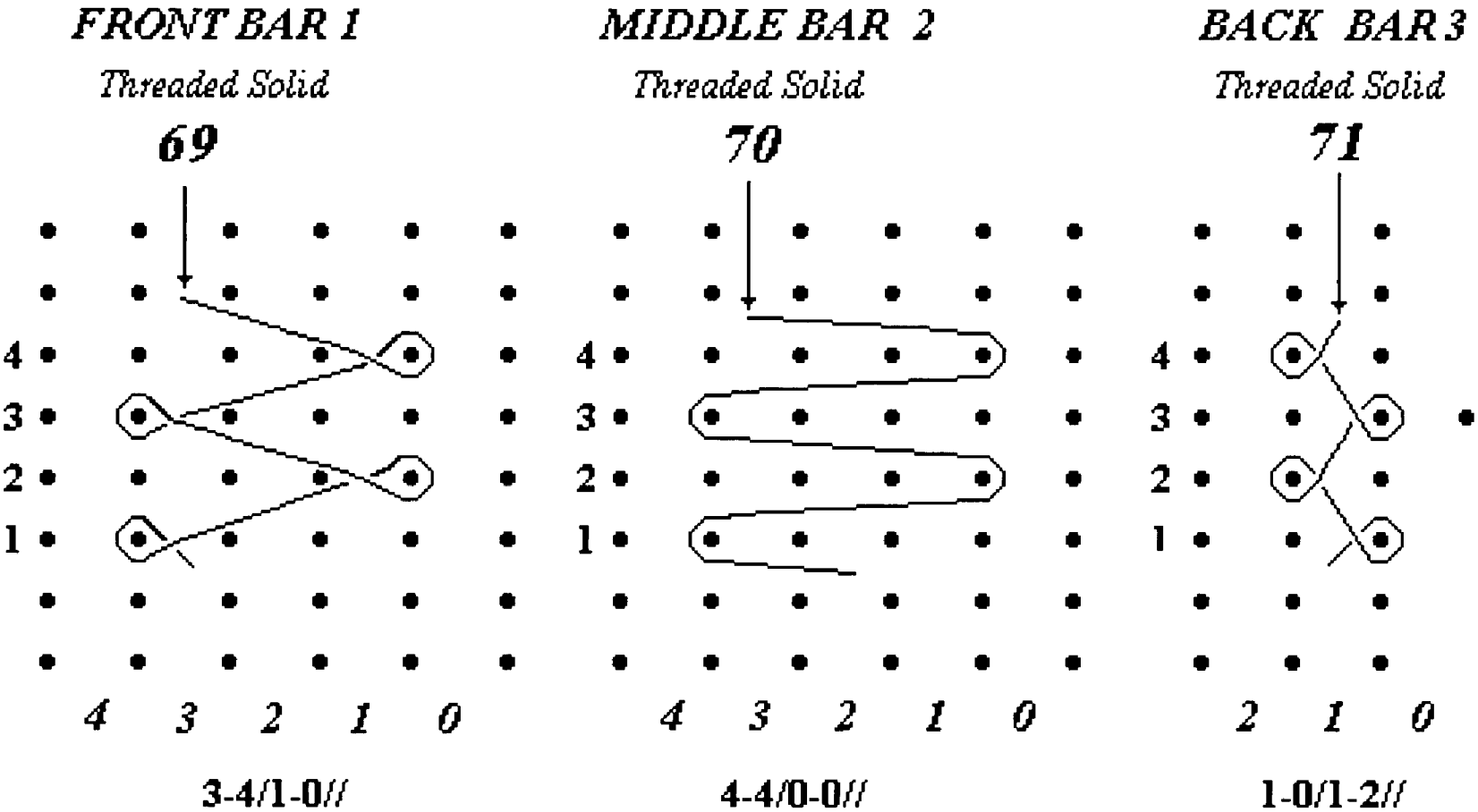
FIG. 2 is an alternative pattern for making a knitted fabric constructed according to an alternative embodiment of the present invention.
Figure 3:
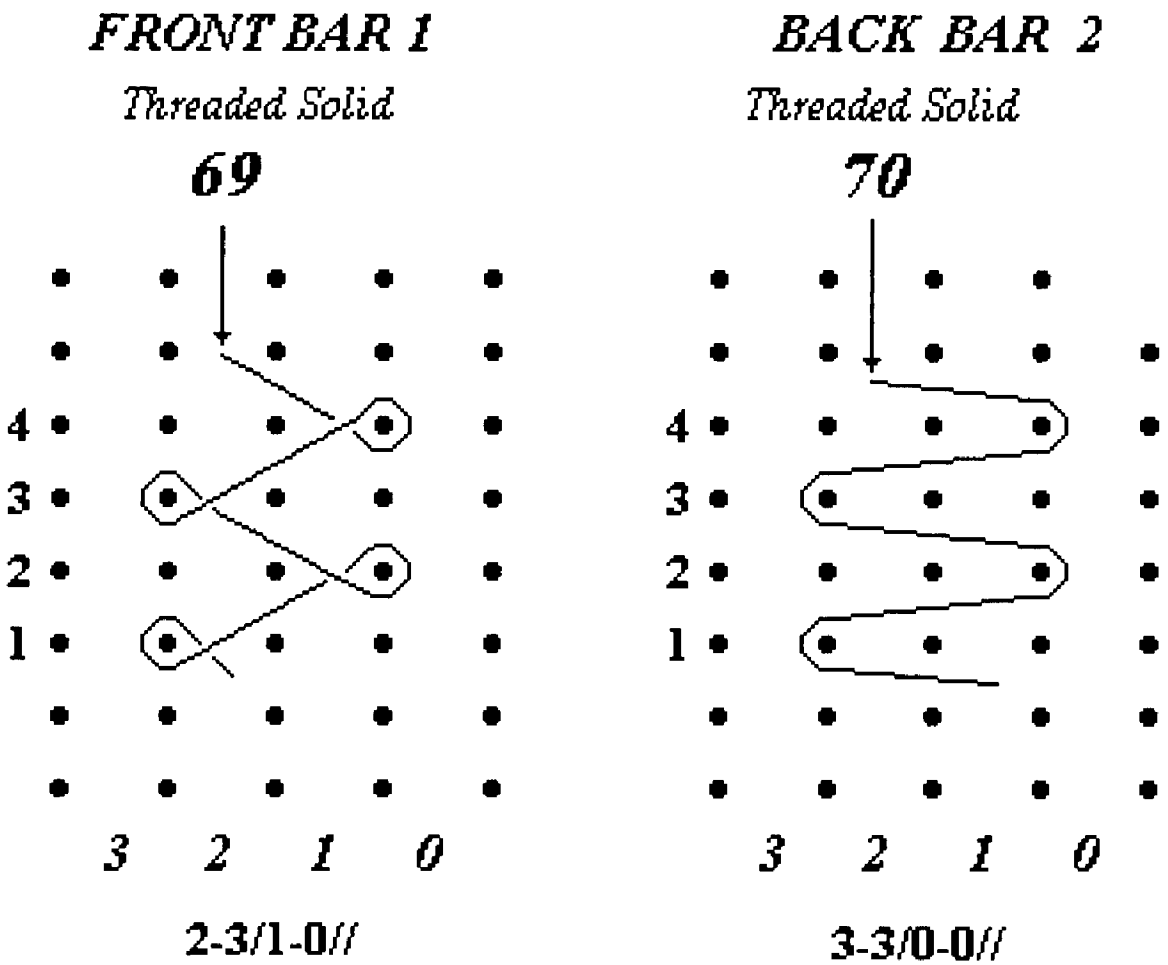
FIG. 3 is an alternative pattern for making a knitted fabric constructed according to an alternative embodiment of the present invention.

Referring now to the drawings in general, the illustrations are for the purpose of describing preferred embodiments of the invention and are not intended to limit the invention thereto. As seen in FIG. 1, a pattern for making a knitted fabric constructed according to the present invention is shown. FIG. 1 shows a 3-bar warp knit tricot fabric knitting pattern, where the front bar 1 is solid threaded with a synthetic continuous multifilament yarn 69; the middle bar 2 is solid threaded with microdenier textured multifilament yarn 70; the back bar 3 is solid threaded with spandex elastomeric yarn 71. Similarly, FIGS. 2 and 3 illustrate alternative patterns for making a knitted fabric constructed according to alternative embodiments of the present invention. FIG. 2 also shows a 3-bar warp knit tricot fabric knitting pattern, where the front bar 1 is solid threaded with a synthetic continuous multifilament yarn 69; the middle bar 2 is solid threaded with microdenier textured multifilament yarn 70; the back bar 3 is solid threaded with spandex elastomeric yarn 71. FIG. 3 shows a 2-bar warp knit tricot fabric knitting pattern, where the front bar 1 is solid threaded with a synthetic continuous multifilament yarn 69; and the back bar 2 is solid threaded with microdenier textured multifilament yarn 70.

These three knitting patterns are provided as examples of embodiments of the present invention, with the 3-bar arrangement being preferred in many applications; however, one of ordinary skill in the relevant art will appreciate that the particular knitting pattern used will depend upon the intended application for the fabric and/or the garment or other end use of the fabric. As such, equivalents to the aforementioned knitting patterns are intended to be included within the scope of the present invention.

The preferred embodiments of the present invention include a two-sided single layer stretch warp knit fabric having a first (face) side and a second (technical back) side identified as such for the purposes of the following description; it will be appreciated that the fabric could be reversible, in which case the first and second side labeling may be used to more generally identify and distinguish the fabric's opposite sides, faces, or surfaces, depending on the application, design, and function of the fabric. The first and second sides are integrally formed using at least two guide bars for the knitting pattern and method for forming the fabric. In a preferred embodiment, three guide bars are used as illustrated by the examples of FIGS. 1 and 2. In an alternative embodiment two guide bars are used, as shown in FIG. 3; in such an embodiment with two guide bars is preferably employed when using stretch synthetic, in particular a stretch polyester or an extra-stretch polyester, such as PBT, and not using elastomeric spandex yarn. The preferred embodiment with three guide bars preferably uses an elastomeric spandex yarn or equivalent thereof. Furthermore, when using the PBT stretch polyester, it can be used in the FIG. 1 or FIG. 2, or FIG. 3 constructions illustrated, and more preferably FIG. 1, on either just the back bar only instead of spandex, or it may be used on both front bar and back bar of the 3-bar construction, as in FIG. 1 or FIG. 2 when using the PBT yarn. Note that typically a preferred embodiment using the PBT stretch polyester yarn is approximately 45 Denier/20 filament yarn.

The method of making such a preferred embodiment once again being set forth in FIGS. 1 and 2, showing a first (front) guide bar, a second (middle) guide bar, and a third (back) guide bar, wherein each of the at least two guide bars are fully or partly threaded.

The first and second sides of the fabric according to the present invention advantageously provides for each side having at least one different quality from the other side, wherein said quality is either quantitatively and/or quantitatively distinguishable between the first and second sides. By way of example and not limitation, said at least one different quality preferably includes color, shade, fiber type, fiber type, pattern, texture, chemical finish, mechanical finish or additional processing, luster or brightness, opacity, reflectivity, and/or wherein the side differences affect fabric performance such as the functional features of wicking, breathability or permeability, water-resistance, stain resistance, comfort, heat transfer, insulation or cooling, flame retardant, and combinations thereof.

In the case of color differences, the first and second sides may have different colors or different shades of the same color, which may be achieved by solution dyeing, yarn dyeing, fabric piece dyeing, and the like. Additionally or alternatively, the first and second sides may have differences such as one of the sides having a metallic color, look or finish, realized by fiber type, finish, coating, and combinations thereof.

Regarding fiber type, preferably the present invention includes synthetic and/or natural fibers and yarns made of synthetic materials, such as nylon, polyester, cotton, etc. The first and second sides may have different fiber types in terms of the material or substance itself, or in terms of the form of the material, such as multifilament, textured multifilament, spun staple, and the like, and combinations thereof.

The inelastic yarns useful in the fabrics of this invention have elongations at break of less than 100% and may be any conventional textile yarns, either continuous-filament (textured or nontextured) or staple yarns or combinations of the two types, including both synthetic fiber and natural fibers, such as nylon, polyester, wool, and cotton. The elastic yarn is preferably segmented polyurethane commonly known as spandex. Additionally or alternatively, a stretch yarn component is preferably used to further enhance the stretch characteristics of the knit structure, such as spandex, poly butylene terephthalate (PBT), i.e., textured polyester that compacts and/or coils when finished, commercially known as ESP (extra stretch polyester), and the like. Furthermore, the fiber size may be different on the first and second sides of the fabric. Fiber sizes may vary from the smallest microdenier to more standard fiber sizes/weights used in apparel and accessories, by way of example including a range of deniers from between about 20 denier to about 150 denier, depending upon the bar on which it is used. Typically, in preferred embodiments of the present invention, as shown in the figures, the first or front bar yarn is between about 20 to about 150 denier, more preferably between about 40 to about 60 denier; the second or middle bar, which provides for the stitch evasion, yarn is between about 40 to about 150 denier, more preferably between about 60 to about 80 denier; and the third or back bar yarn is between about 20 to about 150 denier, more preferably between about 40 to about 60 denier; one of ordinary skill in the art will appreciate that the yarn or fiber sizes selected will vary and depend upon the particular fabric being construction and its intended application, as well as its functional qualities.

Another difference between the first and second sides of the fabric according to the present invention includes the pattern on each side. Pattern differences include printed, embossed, embroidery, specialty yarn, and knitting differences on either side; any variation in pattern from one side to the other that is distinguishable is considered to fall within the scope of the present invention, i.e., the difference need not be highly pronounced, but noticeable by a qualitative and/or quantitative measure.

The texture may also vary between the first and second sides. The two-sided single layer stretch warp knit fabric is preferably formed using a stitch evasion technique that provides for at least 90% quality unique to each side, more preferably at least 95%. The textural differences may be provided by finish-enhanced means, including but not limited to brushed, chemically treated, sueded, sanded, and the like, and combinations thereof, as well as being optionally provided in part due to the yarn differences, as set forth hereinabove.

Another difference between the first and second sides of the fabric according to the present invention is luster and/or brightness, which includes the extremes of bright to dull and anything in-between on the continuum. Opacity may be a further distinguishing quality from the first to second sides of the two-sided single layer stretch warp knit fabric according to the present invention.

Another distinction between sides occurs where the side differences affect fabric performance, i.e., the differences between the sides produce a functional quality in the fabric overall, such as wicking (due to differences in fiber type and size from first to second side and/or to chemical treatment on one or both sides), breathability or permeability, water-resistance, stain resistance, comfort, heat transfer, insulation or cooling, flame retardant, and reflective functions and combinations thereof.

While spandex is not regarded as a flame-resistant material, a stretch-type yarn such as an all polyester yarn that is scoured clean with no finishes, would pass the test for flame-resistance used for testing sleepwear for children. For example, a non-spandex stretch type yarn is PBT.

A range of fabric weights would be suitable for embodiments according to the present invention, preferably, between about four to about twelve oz/yd$^2$, and more preferably, between about six to about seven oz/yd$^2$.

The present invention provides embodiments of aesthetically enhanced fabrics with advantageous performance properties as well as garments and accessories or other articles made using two-sided single layer stretch warp knit fabric according to the present invention, such as garment or accessories. Examples of garment applications according to the present invention include active sportswear, swimwear, performance wear, athletic wear, intimate apparel, medical, fitness wear, industrial/protective wear, sleep wear, military, security or police or other law enforcement protective wear, and the like. Examples of accessory applications of the fabric according to the present invention include wearable accessories, such as gloves, hat, scarf, socks, hat or helmet lining, etc. and other accessories, such as bags, backpacks, suitcases, purses, and the like.

The present invention provides embodiments of single layer double-faced warp knit fabrics having different qualities on the face and back sides that are aesthetically enhanced fabrics with advantageous performance properties, as well as garments and accessories or other articles made using these fabrics.

In one embodiment the present invention includes an integrally formed stretch warp knit fabric structure formed using at least three guide bars, a fully or partly threaded first front guide bar, a second fully or partly threaded middle guide bar and third fully or partly threaded back guide bar that are knitted to form one single layer fabric having a definitive two-sidedness, and even more desirably, two distinctive and different colors on each side as a result.

More specifically, one embodiment of the present invention provides a definitive two-sided single layer warp knit fabric structure with a first technical face side comprised of a fully dyeable synthetic either continuous multifilament or a spun staple length yarn such as nylon or polyester, preferably nylon, and a second technical back side comprised of a textured micro-denier multifilament synthetic yarn such as nylon or polyester, preferably polyester, and a base structure comprised of spandex elastomeric yarn.

Any of the conventional yarn types known in the art may be utilized to produce a warp knit fabric of the present invention, including, but not limited to natural and synthetic yarns produced from spandex, nylon, polyester, viscose, cotton and/or blends thereof. In a preferred embodiment of the present invention the technical back-side of the single layer warp knit fabric is comprised of a substantially resilient and thermosettable continuous filament synthetic yarn. The synthetic yarn may comprise a textured multifilament yarn, a flat non-textured multifilament yarn, or a spun staple yarn wherein the synthetic yarn comprises polyester or nylon. In the case of a flat non-textured multifilament yarn, a higher reflectance surface can be produced thereby imparting a metallic look effect, particularly when the yarn is either solution dyed, yarn dyed, or fabric piece dyed in the into silver or gold metallic looking colors. A similar look may be accomplished when using a preferred textured multi-filament micro-denier polyester yarn which optimizes moisture wicking action when against and in direct contact with the skin of the garment wearer, A particularly desirable combination is achieved when any fashionable color such as navy or red, for example, is dyed only on the yarn visible in the technical face side of the fabric while a contrasting and different color such as silver is dyed on the yarn visible on the technical back side of the fabric, resulting in a silver backed fabric having any color on the reverse face of the product.

In all of the described embodiments of the present invention it is emphasized that the synthetic continuous filament yarn spandex and the synthetic continuous multi-filament or spun staple yarn components of nylon, and polyester used in the first and second discrete technical face and technical back fabric sides are chosen and required in the present invention for their unique hydrophilic or hydrophobic moisture transfer properties as employed in the fabric while still maintaining all functions of fabric stretch, thickness, and comfort breath ability.

Another embodiment of the present invention provides an economic double-faced or distinctly two-sided warp knit fabric that has first and second knit parallel yarn layers integrally knitted and joined together by a series of knit courses forming a resultant single thickness fabric which discretely secures the first and second distinct and different yarn layers together in a tightly spaced relationship parallel to each other.

Another embodiment of the present invention includes a warp knitted single-layer performance fabric that has an optimized moisture wick ability function achieved through effectively combining the distinct hydrophilic properties of an outer technical face yarn area that is intimately connected by construction at a regular and uniform frequency in the knitting sequence to an inner technical back micro-denier hydrophobic yarn area possessing high moisture wicking properties. The yarn selected for the outer technical face surface area is to provide a greater hydrophilic property than the yarn selected for the inner technical back surface area, thereby utilizing a mechanism referred to as a push-pull function for moving the perspiration off the surface of the skin of the garment wearer and efficiently being pulled to the outer surface away from the body and available for evaporation from the outer fabric surface area. This outer surface yarn will also be the visible ingredient in the fabric therefore will be dyed into fashion colors as desired for the appropriate end use such as active sportswear, swimwear, performance wear, athletic wear, intimate apparel, medical, and fitness wear garment applications. The fabric inner surface technical back, which contacts the skin of the wearer, will thus be hidden from view.

A embodiment of the present invention includes a high performance moisture management fabric that is yet further enhanced through chemical means during the dyeing and finishing process by the additional application of finishes such as wickable finish, anti-microbial finish, anti-static finish, softeners, or water repellency finishes applied on the fabric during wet processing, maximizing desirable hydrophobic/hydrophilic fabric properties.

Yet another embodiment of the present invention provides a multi-directional stretch performance fabric. More particularly, in one embodiment, the multi-directional stretch performance fabric utilizes a synthetic polymer spandex elastomeric yarn such as LYCRA yarn produced by the DuPont Company of Wilmington, Del. The inclusion of spandex yarn into the fabric structure is integral to the successful execution of separation of the two distinct yarn systems into technical face and technical back. Alternatively, a non-spandex stretch yarn, such as a stretch polyester or extra-stretch polyester, or similar yarn having stretch properties may be used, depending upon the application for the fabric, including but not limited to additional processing steps and/or use of the fabric, including cleaning and care or fabric maintenance, either alone or in its use as an article, such as a garment or accessory.

Another embodiment of the present invention provides for a sueded or brushed technical back fabric surface for maximizing wearer comfort and increasing the thermal retention properties of the fabric and garment.

Embodiments of the fabric of the present invention may be advantageously utilized in articles of manufacture. Accordingly, the present invention includes articles of manufacture comprising a fabric of the present invention as set forth hereinabove, by way of example and not limitation, a T-shirt, tank top, jacket, pullover, vest, and the like, including the fabrics described in the foregoing.

Methods of making engineered high performance warp knitted double faced fabrics as set forth hereinabove include methods for making fabrics that may have a full dull luster face, a bright or high luster face, a printed face, embossed face, or specialty yarn-faced fabric having a first distinct and opaque outer technical face fabric surface, a second distinct inner technical back fabric surface that may be either fully dull or highly bright in luster, and that will facilitate the manufacturing of finished fashion swimwear, performance competition swimwear, active performance or fitness wear, athletic wear, intimate apparel, and medical garments in a minimal number of manufacturing steps.

A method for forming a multi-directional stretch performance fabric comprising the steps of: providing a warp knitting machine having at least two guide bars with yarn components; providing a knitting pattern for making a single layer warp knit fabric using a stitch evasion technique; forming a two-sided single layer stretch warp knit fabric according to the pattern on the machine, the fabric further comprising a first side and a second side that are integrally formed using the at least two guide bars, such that the first and second sides of the fabric have at least one different quality from the other side, thereby providing a multi-directional stretch performance fabric for use alone or as an article including the fabric.

The preferred method of knitting used to accomplish the present invention is that of "stitch evasion", as set forth below. Now in referring to preferred construction FIG. 1, for example, the yarn (69) of the Front Guide Bar is illustrated as knitting a 2-3/1-0 stitch notation repeat and on the first course numbered 1, the first stitch begins with an overlap of the needle from needle space 2 to needle space 3. (2-3) The yarn (70) threaded in the middle bar 2 which is positioned behind and underneath the front bar 1 yarn sheet in the knitting machine, is simultaneously laid-in at that needle space 3 in a 3-3 stitch notation, thereby making no overlap of the needle in that instance, thus the yarn is free to "stitch evade" or avoid being pinned down by the front bar yarn overlap and is free to surface to the technical back side front most position. In the like manner, Course Number 2 of the 2-course repeat of the Front Bar is notated as a 1-0, making an overlap on the needle between needle space 1 and 0, and the Middle Bar 2 yarn (70) is laid-in at that instance as an 0-0 notation thereby making no overlap of the that needle, and just as in the case of course 1, the yarn is free to surface around the front bar yarn and re-position itself to the front most technical back side of the fabric. The resultant fabric structure then has the middle bar yarn (70) primarily laying in a plane parallel to the warp yarn and surfaced to the front most position, and is tacked down in the fabric only at those certain points whereby the underlaps of adjacent ends from the Front Bar 1 have secured the middle bar yarn (70). The back most Bar 3, which in a preferred embodiment contains an elastomeric Spandex or a stretch PBT polyester yarn, serves to gather and collapse the fabric in both length and width and aids in the forcing of the middle bar 2 yarn (70) to the outward exterior technical back fabric surface. FIG. 2 and FIG. 3 are alternate embodiments that provide the stitch evasion technique but with differing results due to the increased length of the stitch lapping in FIG. 2 and in the case of FIG. 3, the absence of a Back Bar altogether.

Further steps of processing the fabric to create at least one different quality between the first and second sides of the fabric, such as, by way of example and not limitation: napping, brushing, sueding, chemical treating, finishing, printing, embossing, and combinations thereof.

Certain modifications and improvements will occur to those skilled in the art upon a reading of the foregoing description. All modifications and improvements have been deleted herein for the sake of conciseness and readability but are properly within the scope of the following claims.

Design Example(s)

The design examples set forth in the FIGS. 1, 2 and 3 in the foregoing description are not necessarily optimized but illustrative of what can be done for a system and method and indicative of the preferred embodiment at the time of the invention.

What is claimed is:

1. A fabric comprising:

a two-sided single layer warp knit fabric comprising a first side formed by stitches of a first yarn, a second side formed by a stitch evaded portion of a second yarn, and an elastomeric or stretch yarn having an elongation at break of greater than 100%, said elastomeric or stretch yarn incorporated into the fabric, wherein the elastomeric or stretch yarn forces the stitch evaded portion of the second yarn to the second side, and wherein the fabric is integrally formed using at least three guide bars such that the first and second sides have at least one different quality from the other side, thereby providing a fabric for use alone or as an article including the fabric.

2. The fabric according to claim 1, wherein at least three guide bars are used where the warp knit fabric includes a spandex yarn.

3. The fabric according to claim 1, wherein the at least three guide bars include a first front guide bar, a second middle guide bar, and a third back guide bar, wherein the guide bars are each fully or partly threaded.

4. The fabric according to claim 1, wherein the at least one different quality includes a color difference.

5. The fabric according to claim 4, wherein the color difference results from a dyeing process.

6. The fabric according to claim 5, wherein the dyeing process is selected from the group consisting of solution dyeing, yarn dyeing, fabric piece dyeing, and combinations thereof.

7. The fabric according to claim 4, wherein the color difference includes a shade difference.

8. The fabric according to claim 1, wherein the at least one different quality includes at least one side having a metallic appearance.

9. The fabric according to claim 1, wherein the at least one different quality includes a fiber type difference.

10. The fabric according to claim 1, wherein the fabric includes a fiber selected from the group consisting of nylon, polyester, cotton, wool, and combinations thereof.

11. The fabric according to claim 1, wherein the fabric includes a fiber type selected from the group consisting of multifilament, textured multifilament, spun staple, and combinations thereof.

12. The fabric according to claim 1, wherein the stretch yarn component is spandex or poly butylene terephthalate (PBT).

13. The fabric according to claim 1, wherein the at least one different quality includes a fiber size difference between the first and second sides.

14. The fabric according to claim 1, wherein the fabric includes a fiber type including at least one type of microdenier fiber(s).

15. The fabric according to claim 1, wherein the at least one different quality includes a pattern difference between the first and second sides.

16. The fabric according to claim 15, wherein pattern difference is selected from the group consisting of printed, embossed, specialty yarn, embroidery, stitch-based, and the like, and combinations thereof.

17. The fabric according to claim 1, wherein the at least one different quality includes a texture difference between the first and second sides.

18. The fabric according to claim 1, wherein the at least one different quality provides for at least 90% quality unique to each side.

19. The fabric according to claim 1, wherein the at least one different quality includes a finish-enhanced difference between the first and second sides.

20. The fabric according to claim 1, wherein the at least one different quality includes a brushed surface difference between the first and second sides.

21. The fabric according to claim 1, wherein the at least one different quality includes a chemically treated difference between the first and second sides.

22. The fabric according to claim 1, wherein the at least one different quality includes a sueded difference between the first and second sides.

23. The fabric according to claim 1, wherein the at least one different quality includes a sanded face between the first and second sides.

24. The fabric according to claim 1, wherein the at least one different quality includes a brightness difference between the first and second sides.

25. The fabric according to claim 1, wherein the at least one different quality includes an opacity difference between the first and second sides.

26. The fabric according to claim 1, wherein the at least one different quality between the first and second sides affects fabric performance.

27. The fabric according to claim 26, wherein the quality is selected from the group consisting of wicking, breathability, water-resistance, stain resistance, comfort, heat transfer, insulation, cooling, flame retardancy, reflectivity, and combinations thereof.

28. The fabric according to claim 27, wherein the difference is caused by different fiber sizes on the first and second sides.

29. The fabric according to claim 27, wherein the difference is caused by at least one chemical treatment.

30. The fabric according to claim 1, wherein the fabric weight ranges between about four oz/yd$^2$ and about 12 oz/yd$^2$ depending upon the application.

31. The fabric according to claim 1, wherein fiber components forming the fabric have weight ranges between about 20 to about 150 denier.

32. A two-sided single layer warp-knit fabric comprising:

a first side formed by stitches of a first yarn, a second side formed by a stitch evaded portion of a second yarn, and an elastomeric or stretch yarn having an elongation at break of greater than 100%, said elastomeric or stretch yam incorporated into the fabric, wherein the elastomeric or stretch yarn forces. the stitch evaded portion of the second yarn to the second side, the fabric being integrally formed using at least three guide bars, such that the first and second sides have at least one different quality.

33. An article comprising:

a two-sided single layer warp knit fabric comprising a first side formed by stitches of a first yarn, a second side formed by a stitch evaded portion of a second yarn, and an elastomeric or stretch yarn having an elongation at break of greater than 100%, said elastomeric or stretch yarn incorporated into the fabric, wherein the elastomeric or stretch yarn forces the stitch evaded portion of the second yarn to the second side, the fabric being integrally formed using at least three guide bars, wherein the article is formed from the multi-directional stretch performance fabric for providing an article having at least one different quality on its outside and its inside.

34. The article according to claim 33 wherein the article is a garment.

35. The article according to claim 33, wherein the article is used in applications including active sportswear, swimwear, performance wear, athletic wear, intimate apparel, medical, fitness wear, industrial/protective wear, sleep wear, military, security or police or other law enforcement protective wear.

36. The article according to claim 33, wherein the article is an accessory.

* * * * *

UNITED STATES PATENT AND TRADEMARK OFFICE

CERTIFICATE OF CORRECTION

PATENT NO. : 7,465,683 B2
APPLICATION NO. : 10/720947
DATED : December 16, 2008
INVENTOR(S) : Brian L. McMurray It is certified that error appears in the above-identified patent and that said Letters Patent is hereby corrected as shown below:

In Column 2, Line 33, insert a --.-- after the word properties

In Column 4, Line 6, fo should be "of"

In Column 8, Line 35, delete the second occurrence of "fiber type"

In Column 10, Line 53, insert a --.-- after the word wearer

In Column 12, Line 42, before the word needle, delete the word "that"

Signed and Sealed this

Twenty-fourth Day of February, 2009

John Doll

JOHN DOLL
*Acting Director of the United States Patent and Trademark Office*